US008469490B2

(12) United States Patent
Rueby et al.

(10) Patent No.: US 8,469,490 B2
(45) Date of Patent: Jun. 25, 2013

(54) INK TANK CONFIGURATION FOR INKJET PRINTER

(75) Inventors: Christopher Rueby, North Chili, NY (US); Gary Alan Kneezel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 8 days.

(21) Appl. No.: 13/281,861

(22) Filed: Oct. 26, 2011

(65) Prior Publication Data

US 2013/0106964 A1 May 2, 2013

(51) Int. Cl.
*B41J 2/14* (2006.01)

(52) U.S. Cl.
USPC ..... 347/49

(58) Field of Classification Search
USPC ..... 347/49, 85, 86, 87
See application file for complete search history.

(56) References Cited

U.S. PATENT DOCUMENTS

| | | | | |
|---|---|---|---|---|
| 5,602,574 | A | 2/1997 | Williams | |
| 5,619,237 | A * | 4/1997 | Inoue et al. | 347/86 |
| 6,152,555 | A * | 11/2000 | Nozawa et al. | 347/49 |
| 6,375,315 | B1 * | 4/2002 | Steinmetz et al. | 347/86 |
| 7,350,902 | B2 | 4/2008 | Dietl et al. | 347/43 |
| 7,690,774 | B2 | 4/2010 | Petranek et al. | 347/86 |
| 2004/0076447 | A1 | 4/2004 | Matsuo | |
| 2006/0132563 | A1 | 6/2006 | Asai | |

FOREIGN PATENT DOCUMENTS

| | | |
|---|---|---|
| EP | 1 127 696 | 8/2001 |

* cited by examiner

*Primary Examiner* — Anh T. N. Vo
(74) *Attorney, Agent, or Firm* — Peyton C Watkins

(57) ABSTRACT

An ink tank that is detachably mountable to an inkjet printhead, the ink tank includes a first ink source including a first ink supply port; a second ink source including a second ink supply port, the second ink supply port being separated from the first supply ink port along a first direction; and a latch for securing the detachably mountable ink tank, wherein the latch extends from an exterior wall of the ink tank, and wherein the exterior wall is adjacent the second ink source and is not adjacent the first ink source.

8 Claims, 14 Drawing Sheets

INK TANK CONFIGURATION FOR INKJET PRINTER

CROSS REFERENCE TO RELATED APPLICATION

Reference is made to commonly assigned, co-pending U.S. patent application Ser. No. 12/281,844 filed Oct. 26, 2011, entitled "Ink Distribution Configuration for Inkjet Printer" by Christopher Rueby, the disclosure of which is herein incorporated by reference.

FIELD OF THE INVENTION

The present invention relates generally to the field of inkjet printing, and more particularly a configuration of ink distribution in a carriage printer that has reduced susceptibility to acceleration-induced pressure surges.

BACKGROUND OF THE INVENTION

Many types of inkjet printing systems include one or more printheads that have arrays of drop ejectors that are controlled to eject drops of ink of particular sizes, colors and densities in particular locations on the print media in order to print the desired image. Each drop ejector includes a nozzle and a drop forming element, such as a bubble-nucleating heater. In some types of printing systems, the array of drop ejectors extends across the width of the page, and the image can be printed one line at a time. However, the cost of a printhead that includes a page-width array of drop ejectors is too high for some types of printing applications, so a carriage printing architecture is often used.

In an inkjet carriage printing system such as a desktop printer, or a large area plotter, the printhead or printheads are mounted on a carriage that is moved past the recording medium in a carriage scan direction as the drop ejectors are actuated to make a swath of dots. At the end of the swath, the carriage is stopped, printing is temporarily halted and the recording medium is advanced. Then another swath is printed, so that the image is formed swath by swath. In a carriage printer, the drop ejector arrays are typically disposed along an array direction that is substantially parallel to the media advance direction, and substantially perpendicular to the carriage scan direction. The length of the drop ejector array determines the maximum swath height that can be used to print an image.

It is desirable to arrange the different drop ejector arrays with relatively small spacing that is on the order of 2 millimeters or less so that the printhead drop ejector die can be compact and low cost. For carriage printers where the ink tanks are mounted on the carriage, it is desirable to make the ink tanks of high enough capacity so that several hundred pages can be printed before changing tanks. Typical ink tank widths are on the order of 10 millimeters. For a carriage printer having four drop ejector arrays and four corresponding ink tanks, the distance between the outermost nozzle arrays is typically around 6 millimeters, while the distance between the outermost ink tanks is typically around 30 millimeters. For carriage printers having more than four drop ejector arrays and corresponding ink tanks, the difference in distances is even larger. Ink distribution lines are provided, typically in a manifold in the printhead, to route the ink from the ink tanks to the drop ejector arrays. Long ink distribution lines can be disadvantageous in that they provide larger regions where air can become trapped in the printhead.

Faster printing throughput can be achieved by printing at a faster carriage speed. However, the distance d required to accelerate from a stopped position to a constant velocity $v_c$ is given by $d=v_c^2/2a$, where a is the acceleration. Therefore, as the carriage velocity is increased, it is desirable to increase the acceleration so that the width of the acceleration region doesn't increase to unacceptable levels, requiring that the printer be significantly wider than the print media. Such acceleration can cause pressure increases and decreases in the ink distribution lines as the ink sloshes back and forth. In order to further increase printing throughput, some printers print during acceleration and/or deceleration. However, acceleration and deceleration of the carriage can cause ink pressure changes during printing that can result in image quality degradation under certain circumstances, particularly for large magnitudes of acceleration or deceleration.

What is needed is a configuration of ink distribution lines that is less susceptible to large amounts of air becoming trapped, and also less susceptible to pressure surges due to acceleration and deceleration of the carriage.

SUMMARY OF THE INVENTION

The present invention is directed to overcoming one or more of the problems set forth above. Briefly summarized, according to one aspect of the invention, the invention resides in an ink tank that is detachably mountable to an inkjet printhead, the ink tank comprising: a first ink source including a first ink supply port; a second ink source including a second ink supply port, the second ink supply port being separated from the first supply ink port along a first direction; and a latch for securing the detachably mountable ink tank, wherein the latch extends from an exterior wall of the ink tank, and wherein the exterior wall is adjacent the second ink source and is not adjacent the first ink source.

DETAILED DESCRIPTION OF THE INVENTION

Figure 1:
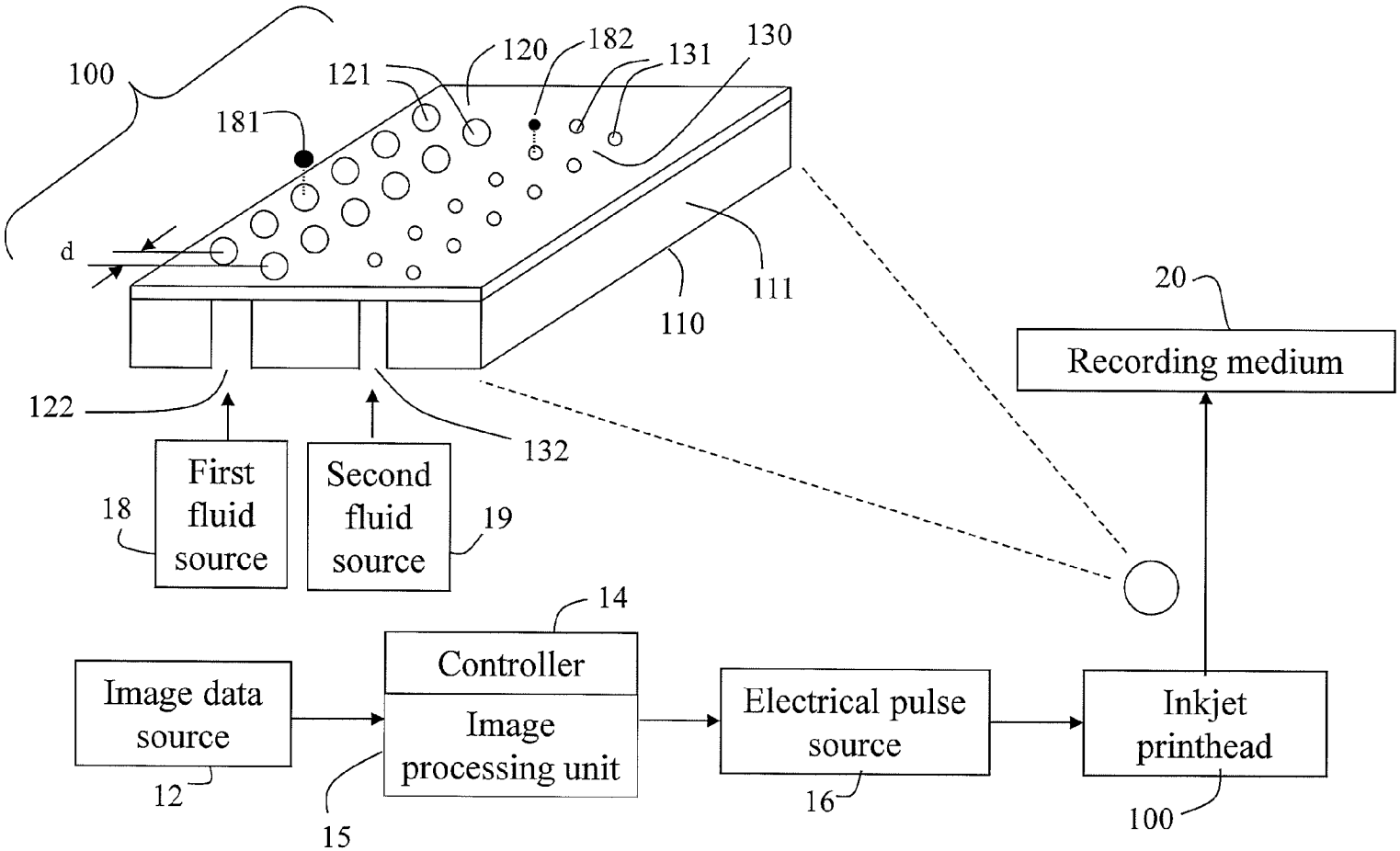
FIG. 1 is a schematic representation of an inkjet printer system that can be used in accordance with the present invention.

Referring to FIG. 1, a schematic representation of an inkjet printer system is shown that is useful with the present invention. This inkjet printer system is fully described in U.S. Pat. No. 7,350,902, which is incorporated by reference herein in its entirety. The inkjet printer system includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110. Optionally, image processing unit 15 is partially included directly in the inkjet printer system, and partially included in a host computer.

In the example shown in FIG. 1, there are two nozzle arrays. Nozzles 121 in a first nozzle array 120 have a larger opening area than nozzles 131 in the second nozzle array 130. In this example, each of the two nozzle arrays 120, 130 has two staggered rows of nozzles 121, 131, each row having a nozzle density of 600 per inch. The effective nozzle density then in each array is 1200 per inch (i.e. d=1/1200 inch in FIG. 1). If pixels on a recording medium 20 were sequentially numbered along the paper advance direction, the nozzles 121, 131 from one row of a nozzle array 120, 130 would print the odd numbered pixels, while the nozzles 121, 131 from the other row of the nozzle array 120, 130 would print the even numbered pixels.

In fluid communication with each nozzle array 120, 130 is a corresponding ink delivery pathway 122, 132. The first ink delivery pathway 122 is in fluid communication with the first nozzle array 120, and the second ink delivery pathway 132 is in fluid communication with the second nozzle array 130. Portions of ink delivery pathways 122 and 132 are shown in FIG. 1 as openings through a substrate 111. One or more inkjet printhead die 110 will be included in inkjet printhead 100, but for greater clarity only one inkjet printhead die 110 is shown in FIG. 1. The inkjet printhead die 110 are arranged on a support member as discussed below relative to FIG. 2. In FIG. 1, a first fluid source 18 supplies ink to the first nozzle array 120 via the first ink delivery pathway 122, and second fluid source 19 supplies ink to the second nozzle array 130 via the second ink delivery pathway 132. Although distinct fluid sources 18 and 19 are shown, in some applications it can be beneficial to have a single fluid source supplying ink to both the first nozzle array 120 and the second nozzle array 130 via ink delivery pathways 122 and 132, respectively. Also, in some embodiments, fewer than two or more than two nozzle arrays 120, 130 can be included on printhead die 110. In some embodiments, all nozzles 121, 131 on inkjet printhead die 110 can be the same size, rather than having multiple sized nozzles on inkjet printhead die 110.

Not shown in FIG. 1, are the drop forming mechanisms associated with the nozzles 121, 131. Drop forming mechanisms can be of a variety of types, some of which include a heating element to vaporize a portion of ink and thereby cause ejection of an ink droplet, or a piezoelectric transducer to constrict the volume of a fluid chamber and thereby cause ejection of an ink droplet, or an actuator which is made to move (for example, by heating a bi-layer element) and thereby cause ejection of an ink droplet. In any case, electrical pulses from electrical pulse source 16 are sent to the various drop ejectors according to the desired deposition pattern. In the example of FIG. 1, ink droplets 181 ejected from the first nozzle array 120 are larger than ink droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on the recording medium 20. A nozzle plus its associated drop forming mechanism are included in a drop ejector. Sometimes herein the terms drop ejector array and nozzle array are used interchangeably.

Figure 2:
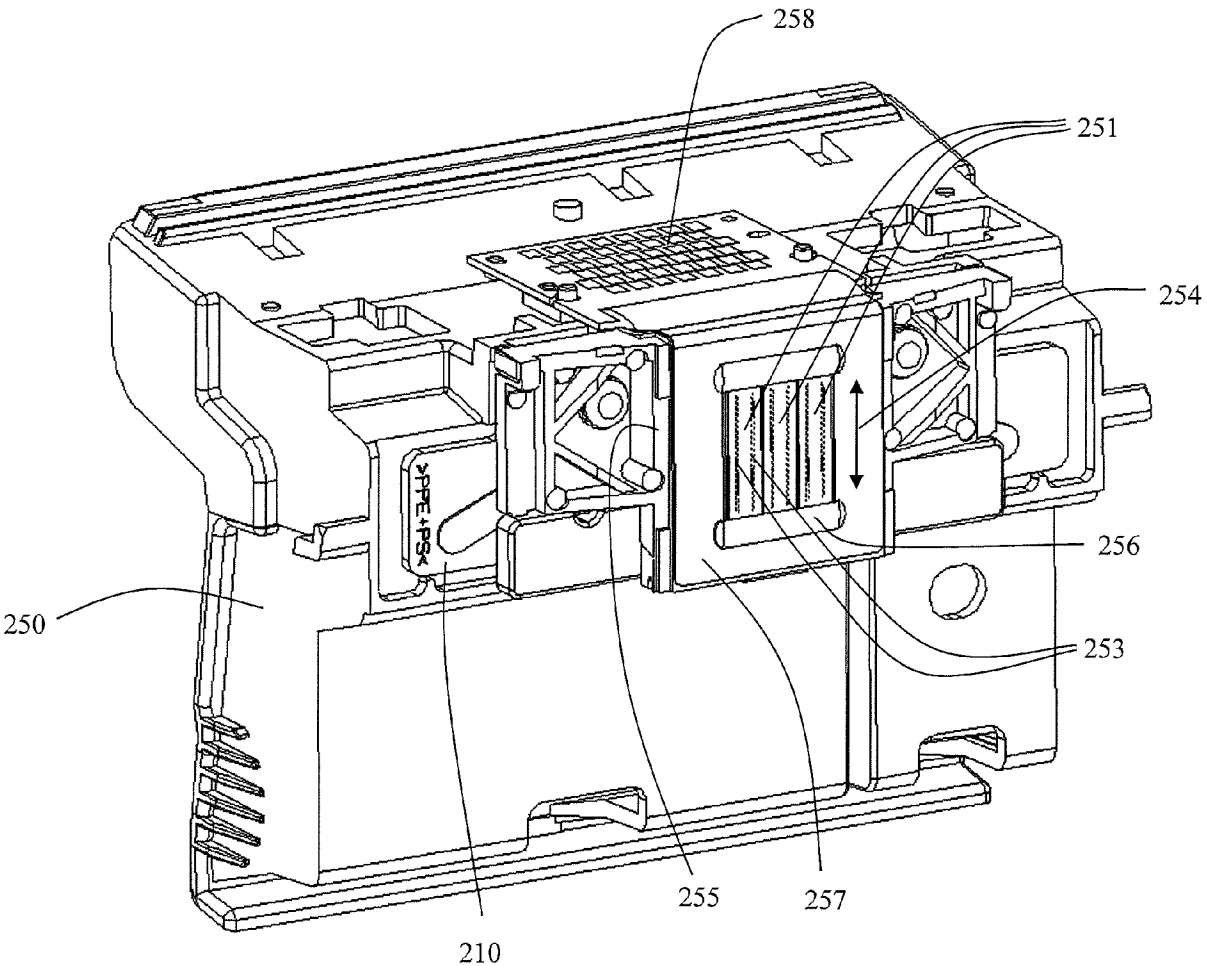
FIG. 2 is a perspective of a portion of a printhead that can be used in the inkjet printer system of FIG. 1.

FIG. 2 shows a perspective of a portion of a printhead 250, which is an example of the inkjet printhead 100 as shown in FIG. 1. Printhead 250 includes three printhead die 251 (similar to printhead die 110 in FIG. 1), each printhead die 251 containing two nozzle arrays 253, so that printhead 250 contains six nozzle arrays 253 altogether. The three printhead die 251 are bonded to a mounting support member 255, which provides a planar mounting surface for the printhead die 251, as well as ink feed passages (not shown) that provide ink to respective ink openings in the substrates of printhead die 251. Manifold 210 (described below with reference to FIG. 9) provides ink passages that lead to the corresponding ink feed passages of mounting support member 255. The six nozzle arrays 253 in this example can be each connected to separate ink sources (not shown), such as cyan, magenta, yellow, black and a colorless fluid. Other configurations of printheads described below only include four nozzle arrays. The number of nozzle arrays in the printhead is not central to the invention.

Each of the six nozzle arrays 253 is disposed along a nozzle array direction 254, and the length of each nozzle array 253 along the nozzle array direction 254 is typically on the order of 1 inch or less. Typical lengths of recording media are 6 inches for photographic prints (4 inches by 6 inches), or 11 inches for cut sheet paper (8.5 by 11 inches) in a desktop carriage printer, or several feet for roll-fed paper in a wide format printer. Thus, in order to print a full image, a number of swaths are successively printed while moving printhead 250 across the recording medium 20. Following the printing of a swath, the recording medium 20 is advanced in a direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into a carriage 200 (see FIG. 3), connector board 258 is electrically connected to a connector (not shown) on the carriage 200, so that electrical signals can be transmitted to the printhead die 251.

Figure 3:
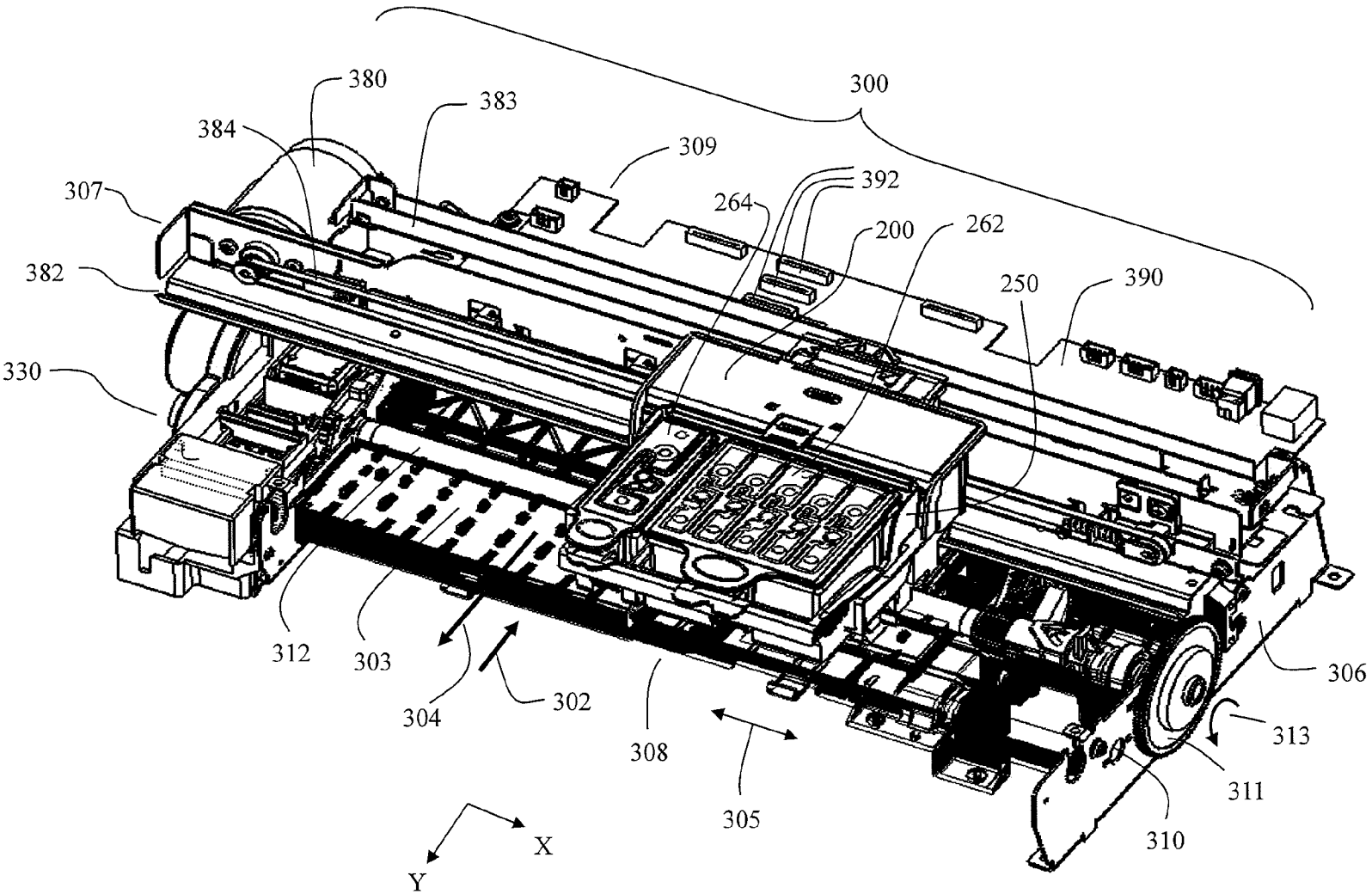
FIG. 3 is a top perspective of a portion of a carriage printer.

FIG. 3 shows a top perspective of a printer chassis 300 for a desktop carriage printer. Some of the parts of the printer have been hidden in the view shown in FIG. 3 so that other parts can be more clearly seen. The printer chassis 300 has a print region 303 across which carriage 200 is moved back and forth (also sometimes called rightward and leftward passes herein) along carriage scan direction 305 (parallel to the X axis), between the right side of printer chassis 306 and the left side of printer chassis 307, while drops are ejected from printhead die 251 (not shown in FIG. 3) on printhead 250 that is mounted on carriage 200. A carriage motor 380 moves a belt 384 to move carriage 200 laterally along a carriage guide 382 in reciprocating fashion. An encoder sensor (not shown) is mounted on carriage 200 and indicates carriage location relative to an encoder fence 383.

Printhead 250 is mounted in carriage 200, and a multi-chamber ink supply 262 and a single-chamber ink supply 264 are detachably mounted in the printhead 250. The mounting orientation of printhead 250 is rotated relative to the view in FIG. 2, so that the printhead die 251 are located at the bottom side of printhead 250, the droplets of ink being ejected downward onto the recording medium 20 in print region 303 in the view of FIG. 3. Paper or other recording medium (sometimes generically referred to as paper or media herein) is loaded along a paper load entry direction 302 toward a front of printer chassis 308.

Figure 4:
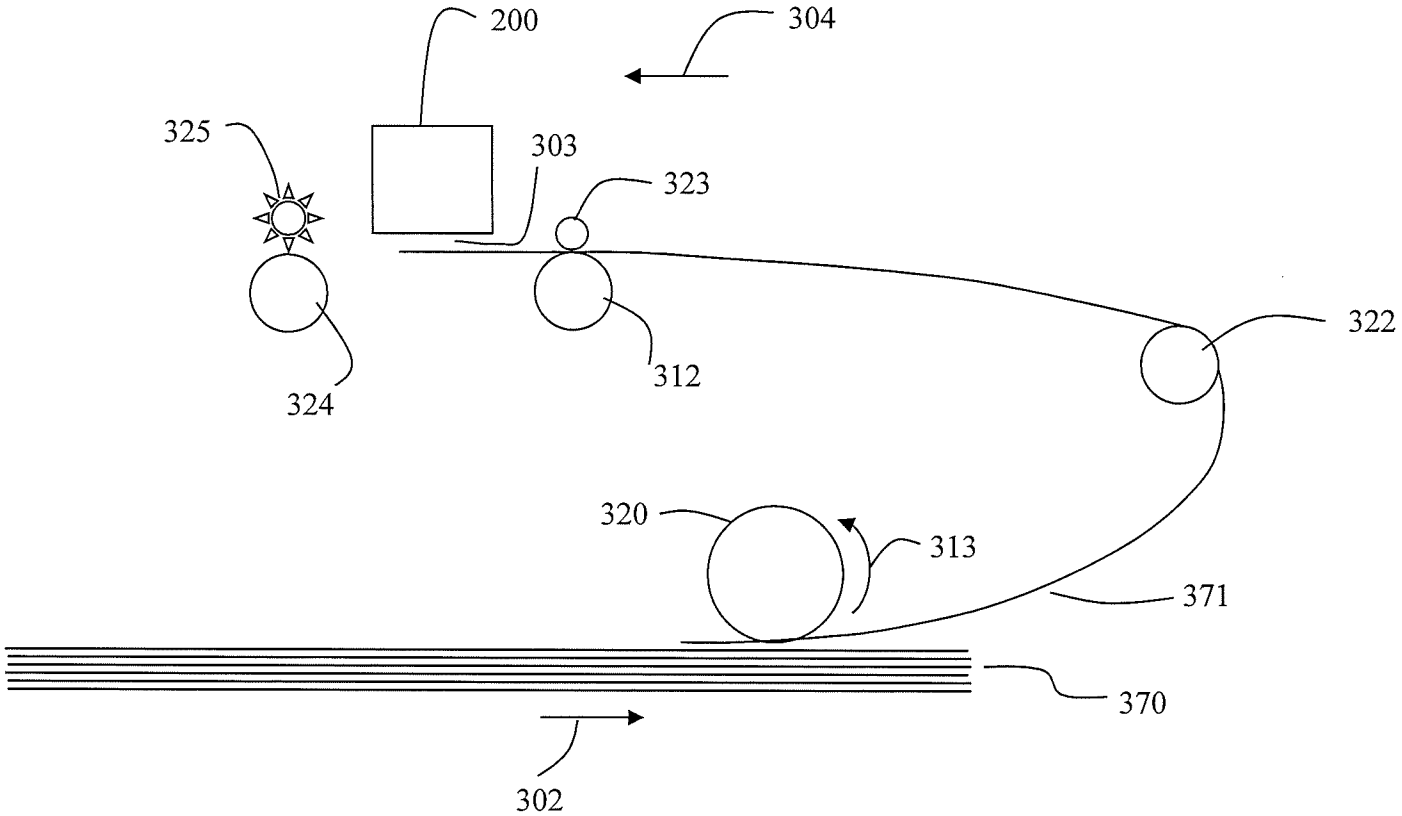
FIG. 4 is a schematic side view of an exemplary paper path in a carriage printer.

A variety of rollers are used to advance the medium through the printer as shown schematically in the side view of FIG. 4. In this example, a pick-up roller 320 moves a top piece or sheet 371 of a stack 370 of paper or other recording medium in the paper load entry direction 302. A turn roller 322 acts to move the paper around a C-shaped path (in cooperation with a curved rear wall surface) so that the paper continues to advance along media advance direction 304 from the rear of the printer chassis 309 (with reference to FIG. 3). The paper is then moved by a feed roller 312 and idler roller 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 (see FIG. 3) is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but a hole 310 on the right side of the printer chassis 306 is where the motor gear (not shown) protrudes through in order to engage feed roller gear 311, as well as the gear for the discharge roller (not shown). For normal paper pick-up and feeding, it is desired that all rollers rotate in a forward rotation direction 313. Toward the left side of the printer chassis 307, in the example of FIG. 3, is a maintenance station 330.

Toward the rear of the printer chassis 309, in this example, is located an electronics board 390, which includes cable connectors 392 for communicating via cables (not shown) to the printhead carriage 200 and from there to the printhead 250. Also on the electronics board 390 are typically mounted motor controllers for the carriage motor 380 and for the paper advance motor, a processor or other control electronics (shown schematically the controller 14 and image processing unit 15 in FIG. 1) for controlling the printing process, and a connector for a cable to a host computer.

Figure 5:
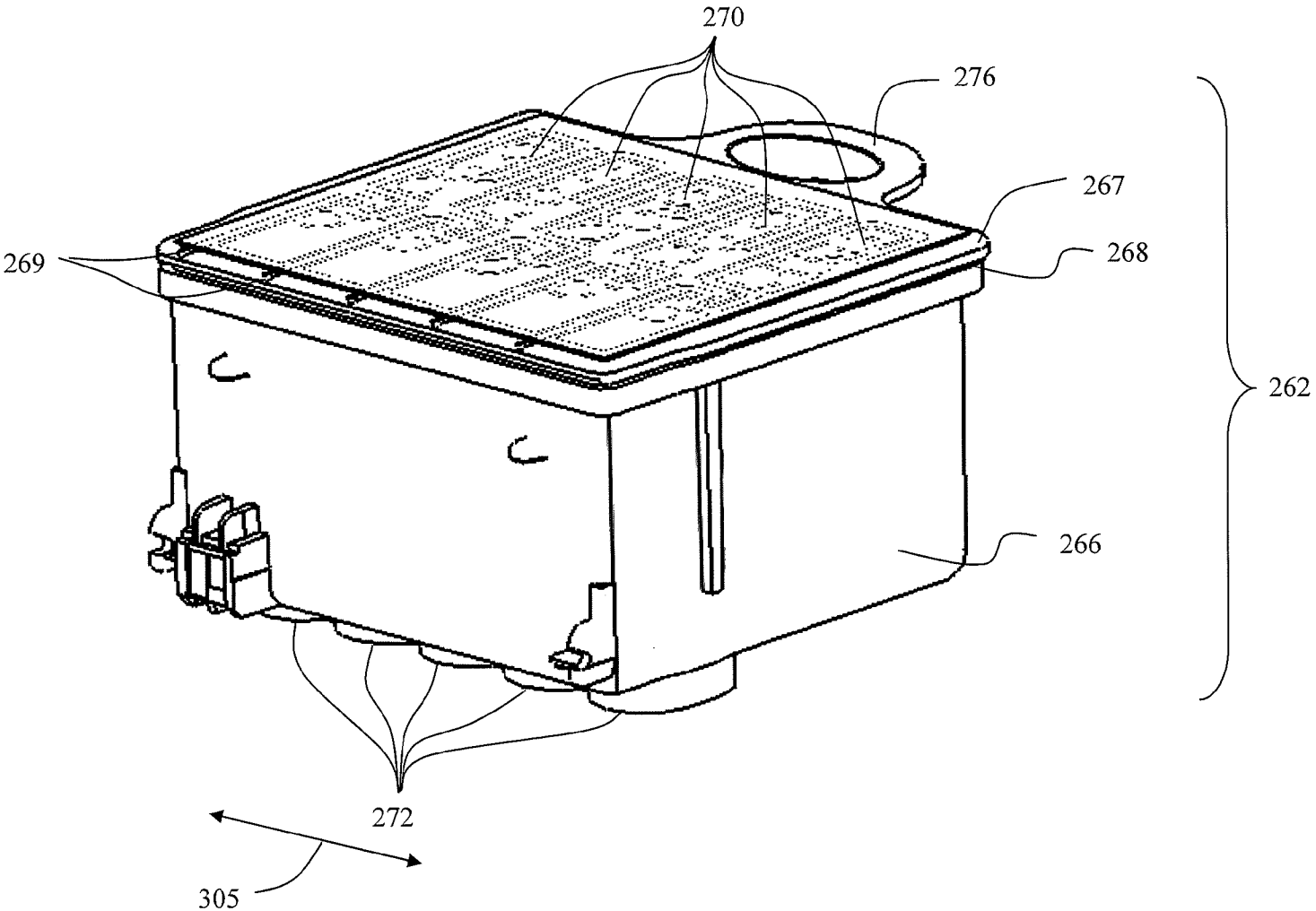
FIG. 5 Prior Art
FIG. 5 is a perspective of a prior art multi-chamber ink supply.

FIG. 5 shows a perspective of the prior art multi-chamber ink supply 262 removed from printhead 250. Multi-chamber ink supply 262 includes a supply body 266 and a lid 267 that is sealed (e.g. by welding) to ink supply body 266 at lid sealing interface 268. A protruding grip 276 extends outwardly from lid 267. Lid 267 individually seals all of the chambers 270 in the ink supply. In the example shown in FIG. 5, multi-chamber ink supply 262 has five chambers 270 below lid 267, and each chamber 270 has a corresponding ink supply port 272 that is used to transfer ink to the printhead die 251. As shown in FIG. 3, the ink supplies 262 and 264 are mounted on the carriage 200 printer chassis 300, such that the lid 267 is at an upper surface, and correspondingly ink supply ports 272 are at a lower surface. Corresponding to each chamber position, there is a circuitous air path in lid 267 (shown as dotted lines) that exits the side of lid 267 at vents 269 (only two of which are labeled in FIG. 5 for improved clarity). Vents 269 help to relieve pressure differences in chamber 270 as ink is depleted during usage.

Figure 6:
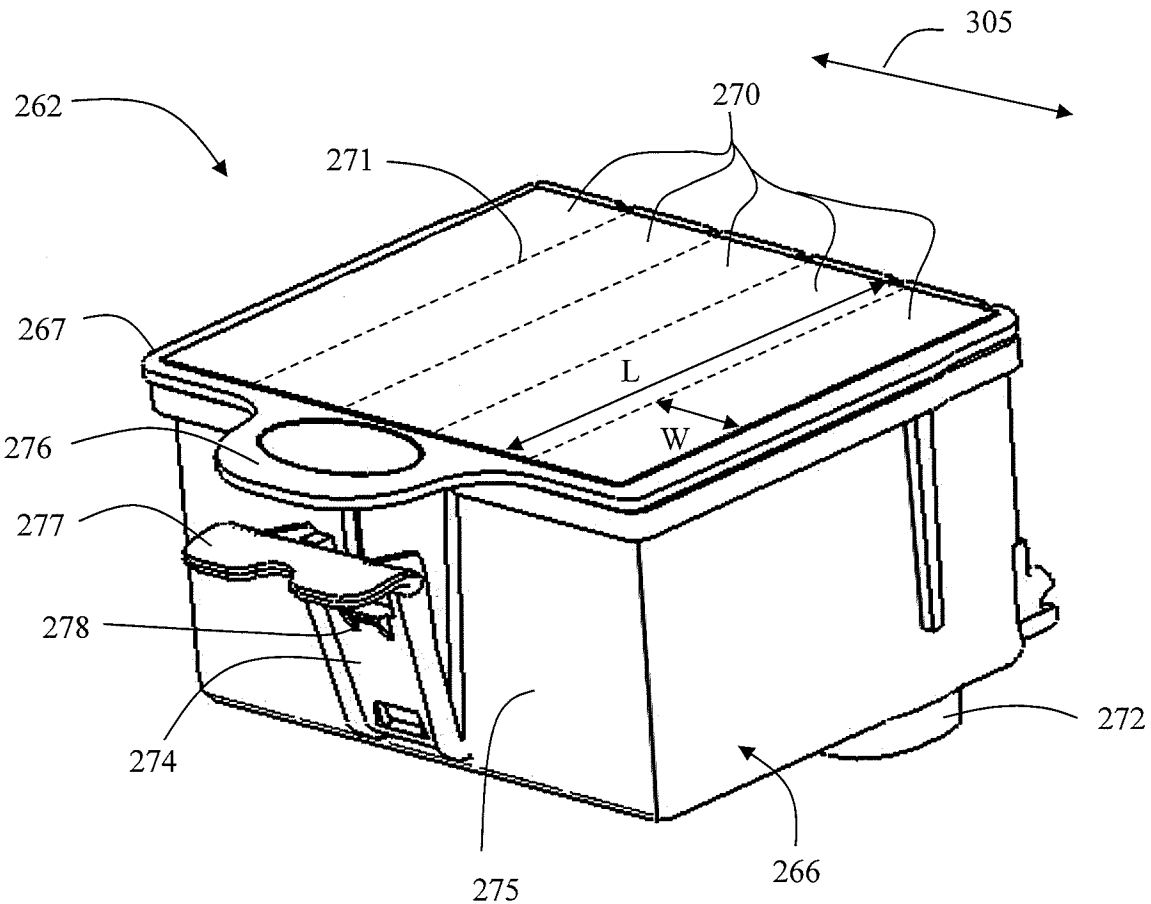
FIG. 6 Prior Art
FIG. 6 is a perspective of the prior art multi-chamber ink supply that is rotated relative to FIG. 5.

In FIG. 5, the carriage scan direction 305 is indicated for reference in order to indicate orientation of prior art multi-chamber ink supply when it is mounted on carriage 200 as in FIG. 3. Referring to FIG. 6, chambers 270 have a width W along carriage scan direction 305 and a length L along a direction perpendicular to carriage scan direction 305, where L is greater than W. Aspects of the present invention that differ from prior art multi-chamber ink supply 262 are the configuration of ink supply ports 272 and the configuration of chambers 270. In prior art detachably mountable multi-chamber ink supply 262, the ink supply ports 272 are arranged in a single line along carriage scan direction 305, and the chambers 270 are arranged side by side in a single row along carriage scan direction 305.

Figure 7:
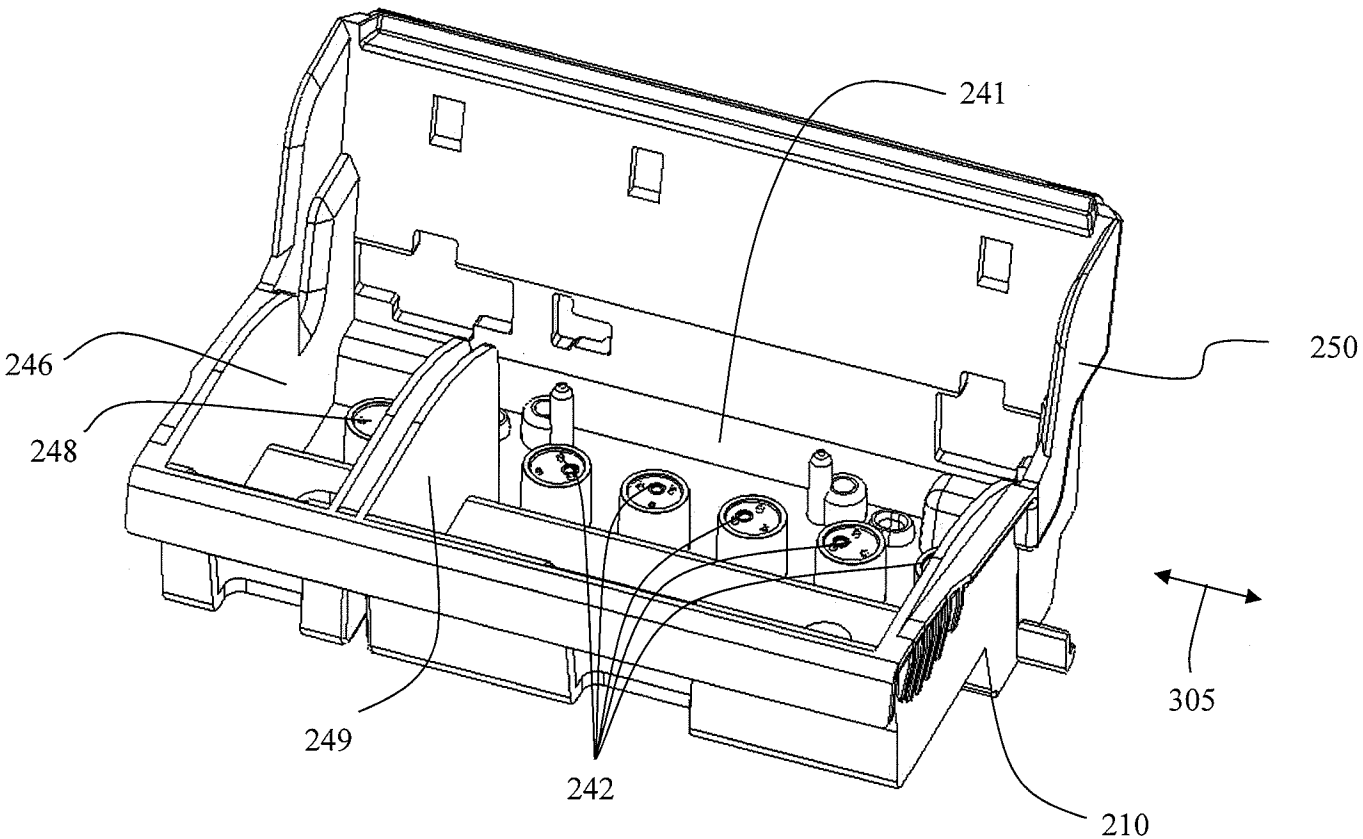
FIG. 7 Prior Art
FIG. 7 is a perspective of a portion of a prior art printhead.

FIG. 6 shows the prior art multi-chamber ink supply 262 of FIG. 5 but in a perspective that is rotated to show further detail in the vicinity of protruding grip 276. Ink supply body 266 includes an exterior wall 275 over which protruding grip 276 extends. As is described in U.S. Pat. No. 7,690,774, incorporated herein by reference, a lever 274 is attached to exterior wall 275. Lever 274 includes a latch 278 and an opposing grip 277. A user can use protruding grip 276 and opposing grip 277 as a handle to carry multi-chamber ink supply 262. Latch 278 is used to secure multi-chamber ink supply 262 when it is installed in printhead 250 (FIGS. 3 and 7). Dashed lines 271 represent internal walls separating the ink chambers 270. Exterior wall 275 is common to all five chambers 270 in prior art multi-chamber ink supply 262. In that sense, latch 278 and handle 276, 277 are proximate to all five ink sources in the five chambers 270, because latch 278 and handle 276, 277 extend from an exterior wall 275 that is adjacent to all five chambers 270.

FIG. 7 shows a top perspective of prior art printhead 250 without either detachably mountable ink supply 262 or 264 mounted in it. Multi-chamber ink supply 262 is mountable in a multi-chamber ink supply region 241 and single-chamber ink supply 264 is mountable in a single-chamber ink supply region 246 of printhead 250. Multi-chamber ink supply region 241 is separated from single-chamber ink supply region 246 by partitioning wall 249, which can also help guide the ink supplies during insertion. Five multi-chamber ink supply connection ports 242 are shown in multi-chamber ink supply region 241 that connect with ink supply ports 272 of multi-chamber ink supply 262 when it is installed, and one single-chamber ink supply connection port 248 is shown in single-chamber ink supply region 246 for the ink supply port on the single-chamber ink supply 264. When an ink supply is installed in the printhead 250, it is in fluid communication with the printhead because of the connection of ink supply port 272 with connection ports 242 or 248. When the printhead 250 is installed in carriage 200 of the printer (with reference to FIG. 3), connection ports 242 and 248 are displaced with respect to each other along the carriage scan direction 305.

In order to provide sufficient capacity for storing ink, the ink chambers 270 are typically wider than the spacing between drop ejector arrays 253 (with reference to FIG. 2), so that connection ports 242 and 248 are not directly in line with ink feed passages in mounting support member 255. In other words, the connection ports 242 and 248 are more widely spaced along carriage scan direction 305 than the drop ejector arrays 253.

Figure 8:
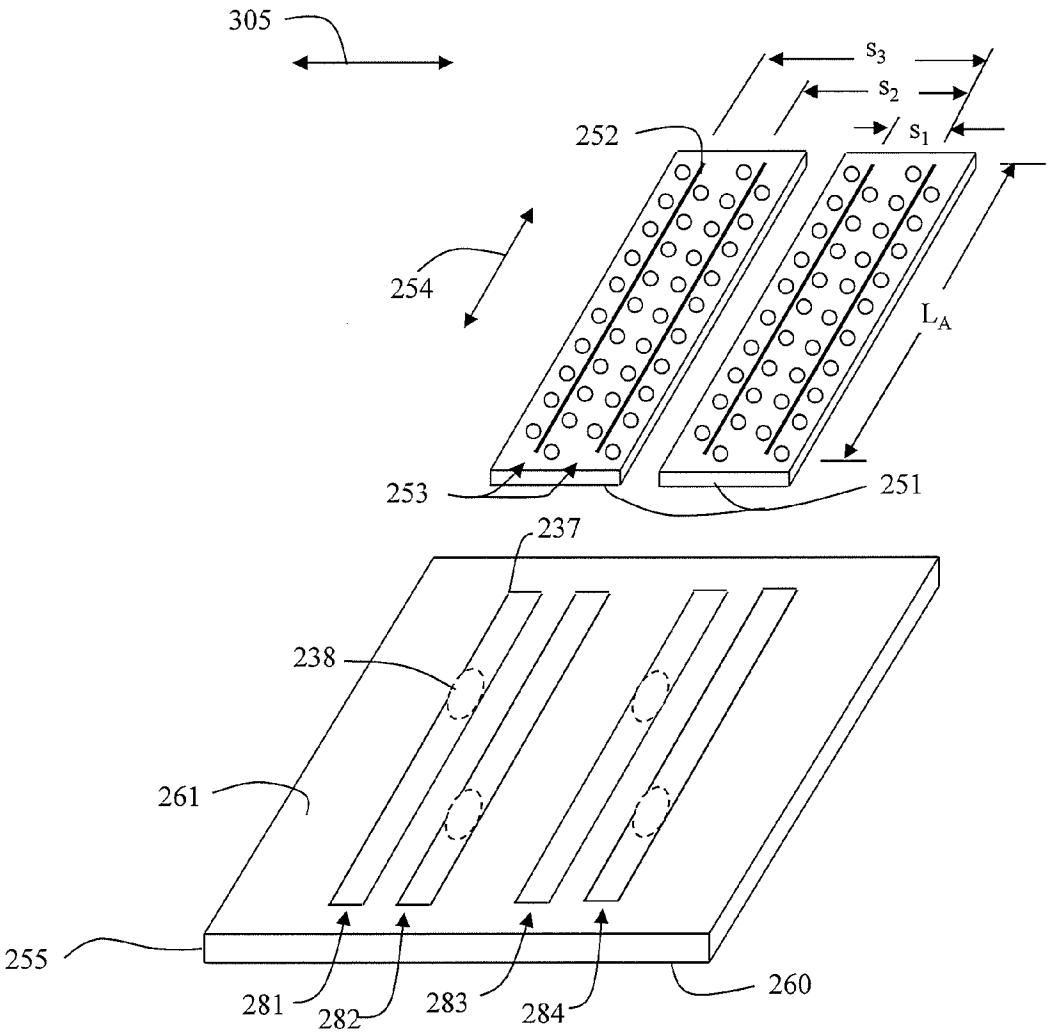
FIG. 8 is a bottom exploded perspective of printhead die and a mounting support member.

Referring to the bottom exploded view of FIG. 8, the mounting support member 255 and the printhead die 251 are shown detached from each other for more clearly illustrating their cooperative interaction. In this example, two printhead die 251 are shown although more than two printhead die 251 can be used or alternatively only one printhead die 251 can be used depending on design choice. Since in this example each printhead die 251 includes two nozzle arrays 253, there are four nozzle arrays total, so that the mounting substrate 255 includes four ink feed passages 281-284. For an example as in FIG. 2 where there are three printhead die, each having two nozzle arrays 253, there would be six ink feed passages 281-286 (see FIG. 9). The plurality of ink feed passages 281-284 each include an elongated opening 237 that is disposed on die attach surface 261 as well as an opening 238 that is disposed on ink entry surface 260. (The openings 238 are shown in dashed lines indicating their physical location is on the opposite surface from die attach surface 261). Ink is transported from the ink manifold outlets 211-214 (FIG. 9) and respectively into the openings 238 in mounting support member 255. Each opening 238 disperses the received ink into the respective ink feed passages 281-284. Each printhead die 251 includes a plurality of ink feeds 252 that are respectively mated to the ink feed passages 281-284 when the printhead die 251 are bonded to mounting support member 255. Nozzle array 253 is aligned along a nozzle array direction 254 and has a nozzle array length $L_A$. Ink feed passages 281-284 and ink feeds 252 are also aligned along the nozzle array direction 254. Ink feeds 252 bring the ink to the respective nozzle arrays 253, so that manifold outlets 211-214 are fluidically connected to corresponding nozzle arrays 253.

Carriage scan direction 305 is indicated for reference in FIG. 8 in order to show the orientation of the nozzle arrays in the printer. Spacings between the nozzle arrays 253 are indicated as distances $s_1$, $s_2$ and $s_3$. Typically the spacing between nozzle arrays 253 within the printhead die 251 (also called the intra-die array separation) is the same for both printhead die 251. For the configuration shown in FIG. 8, this indicates that $s_3-s_2=s_1$. In some embodiments, as in FIG. 8, adjacent printhead die 251 are spaced apart along the carriage scan direction, so that a pair of adjacent nozzle arrays 253 on two different printhead die 251 has a spacing (also called the inter-die array separation) that is greater than the intra-die array spacing. For the configuration shown in FIG. 8, this indicates $s_2-s_1>s_1$. As a result, ink feed passages 283 and 282 are farther apart than are either ink feed passages 281 and 282 or ink feed passages 283 and 284.

Figure 9:
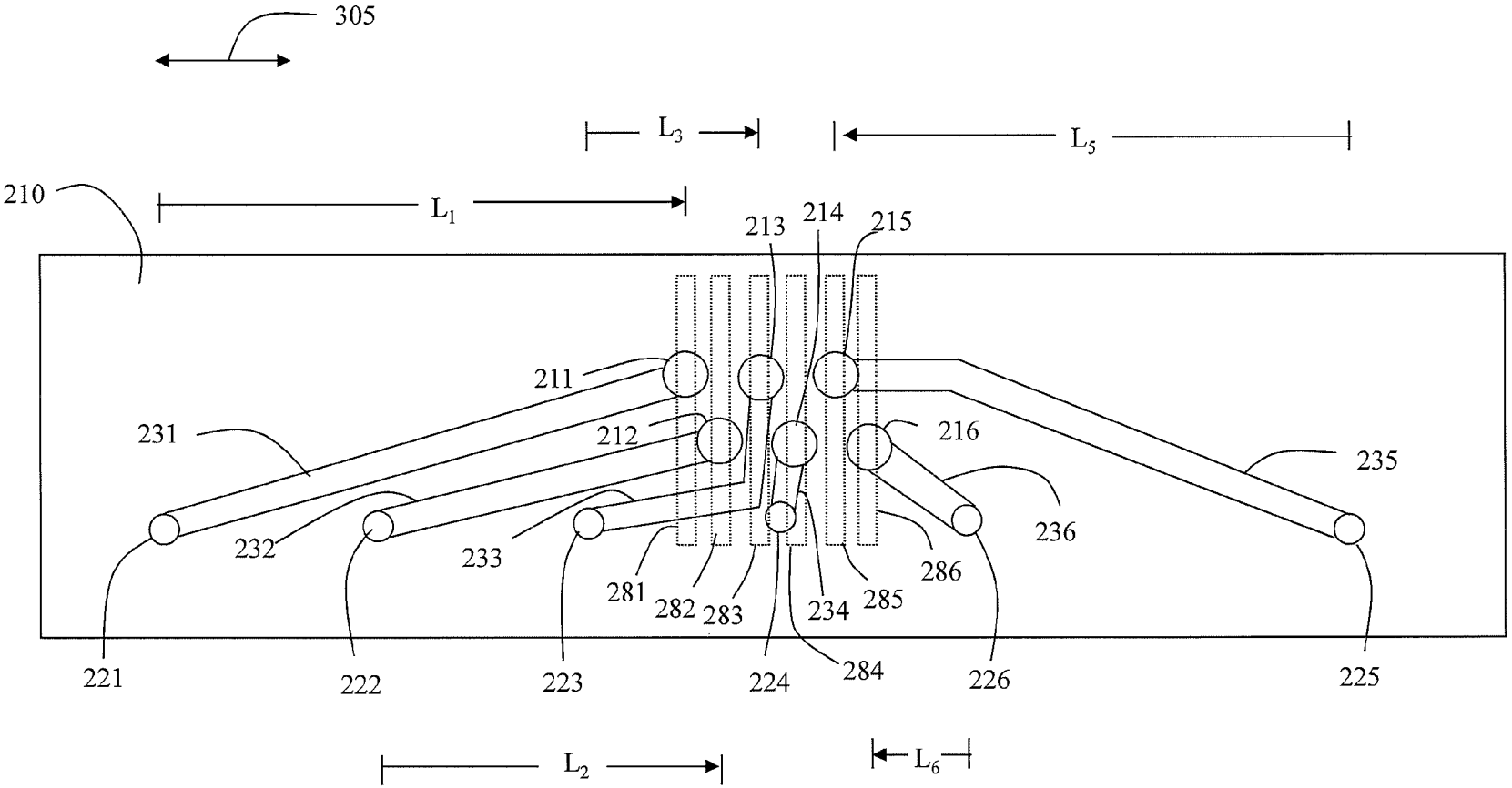
FIG. 9 Prior Art
FIG. 9 is a bottom view of a prior art manifold for providing ink passages from ink supply ports to feed passages near ink openings in the printhead die.

FIG. 9 shows a bottom view of a prior art manifold 210 that provides passageways from connection ports 242 and 248 (FIG. 7) to the ink feed passages 281-286 (shown as dotted rectangles to indicate their position relative to the manifold 210) in mounting support member 255 in order to provide ink to respective ink openings in the substrates of printhead die 251. Manifold 210 includes six manifold outlets 211-216 that are aligned respectively with the six ink feed passages 281-286 in mounting substrate 255. Ink enters manifold 210 at manifold inlets 221-226, which are aligned with the connection ports 242 and 248 at a face opposite the face where the ink supply ports 272 contact. In a particular example, the distance between endmost ink feed passages 281 and 286 is about 1 cm, and the distance between endmost manifold inlets 221 and 225 is about 7 cm.

Manifold passages 231-236 are provided to bring ink from a manifold inlet to the corresponding manifold outlet. The manifold passages 231-236 have projections along the carriage scan direction 305 that are of different lengths. In other words, manifold passage 231 (joining manifold inlet 221 and manifold outlet 211) has a projection along carriage scan direction 305 of length $L_1$. Manifold passage 233 (joining manifold inlet 223 and manifold outlet 213) has a carriage-scan projection along carriage scan direction 305 of length $L_3$, where $L_3<L_1$. The carriage-scan projection for manifold passage 234 is very short and is not labeled for clarity. In FIG. 9, which represents a bottom view of manifold 210, manifold inlets 221-224 are to the left of the corresponding manifold outlets 211-214, while manifold inlets 225 and 226 are to the right of the corresponding manifold outlets 215 and 216.

Manifold inlet 225 corresponds to single-chamber ink supply 264, which typically holds black ink for printing text. In the top perspective of the printer chassis seen in FIG. 3, the single-chamber ink supply 264 is to the left of multi-chamber ink supply 262. Thus, as the carriage is moved along carriage scan direction 305 from the left side of the printer chassis 307 toward the right side of the printer chassis 306 (a rightward printing pass), the direction of carriage travel is in the same direction as the projection $L_5$ of manifold passage 235 from the manifold inlet 225 to the manifold outlet 215. For a leftward printing pass, the direction of carriage travel is in the opposite direction of the projection $L_5$ of manifold passage 235 from the manifold inlet 225 to the manifold outlet 215.

As the carriage accelerates at the beginning of its travel and decelerates at the end of its travel, this produces a pressure change in the ink at the nozzles 121, the magnitude and sign of which depend on direction of travel, acceleration vs. deceleration, length of the carriage-scan-axis projection of the manifold passage, and direction of the carriage-scan-axis projection of the manifold passage from the manifold inlet to the manifold outlet. Such pressure changes can have adverse effects on printing during acceleration and deceleration. Excessive positive pressure can cause the ink meniscus to advance so far beyond the nozzle face that the meniscus breaks and floods the nozzle face with ink. Excessive negative pressure can cause the ink meniscus to retreat from the nozzle face so that the drop volume can become smaller, and the refill frequency is lowered.

The pressure change on the ink at one of the ink feed passages 281-286 due to ink in the corresponding manifold passage 231-236 between one of the manifold inlets 221-226 and the corresponding manifold outlet 211-216 can be expressed in terms of ρ (the density of ink), a (the carriage acceleration magnitude "a" and direction), and L (the projection of the manifold passage along the carriage scan direction). Let Δl be a vector describing a straight portion of a manifold passage where the starting point of the vector is closer to the manifold inlet and the ending point of the vector is closer to the manifold outlet. For straight line manifold passages such as 231, 232, 234 and 236, Δl is the vector from the manifold inlet to the manifold outlet. For manifold passages such as 233 and 235, which are made of a plurality of segments, the contributions from the segments can be summed or integrated. Acceleration is positive if velocity is increasing or negative if velocity is decreasing (i.e. the carriage is decelerating). The change in pressure ΔP is given by:

$$\Delta P = -\rho\Delta 1 \cdot a = -\rho\Delta 1 a\cos\theta, \quad (1)$$

where θ is the angle between the acceleration vector and the vector describing the straight portion of the manifold passage. Since the acceleration is along the carriage scan direction 305, the dot product Δl·a is the magnitude of acceleration times the projection of the segment of the manifold passage along the carriage scan axis 305. Whether for a single segment or multiple straight segments, the magnitude of the pressure change is:

$$|\Delta P| = \rho S a, \quad (2)$$

where S is the carriage-scan-axis projection of the entire manifold passage from the manifold inlet to the manifold outlet.

If the velocity is increasing, and a line from the manifold inlet to the manifold outlet has a carriage-scan-axis projection that points in the direction that the carriage is traveling, then the pressure change ΔP at the ink feed passage is negative, corresponding to a negative pressure change on the ink meniscus at the nozzles that are fed by that ink feed passage. If the velocity is increasing and the projection points opposite the direction that the carriage is traveling, then the pressure change at the ink feed passage is positive. Similarly, if the velocity is decreasing and the projection points in the direction that the carriage is traveling, then the pressure change at the ink feed passage is positive, but if the projection points opposite the direction that the carriage is traveling, then the pressure change at the ink feed passage is negative.

Consider an example, with reference to the bottom view of FIG. 9, where length projection $L_1$ of manifold passage 231 is 3 cm pointing to the right, length projection $L_3$ of manifold passage 233 is 1 cm pointing to the right, and length projection $L_5$ of manifold passage 235 is 3 cm pointing to the left. Assume that the inks in those manifold passages have a density of approximately 1 g/cm$^3$, and that the acceleration is 2000 cm/s$^2$ (about 2× the acceleration due to gravity) with carriage velocity increasing and with manifold 210 moving toward the right in the bottom view of FIG. 9 (i.e. the carriage 200 is moving toward the left in a leftward pass in the top perspective view of FIG. 3). Then the pressure at ink feed passage 281 will increase by about 6000 dynes/cm$^2$, the pressure at ink feed passage 283 will increase by about 2000 dynes/cm$^2$, and the pressure at ink feed passage 285 will decrease by about 6000 dynes/cm$^2$.

The effect of a pressure change depends on how large the pressure change is. If a first drop ejector array is fed, for example, by ink feed passage 281, and a second drop ejector array is fed by ink feed passage 283, it is found that printing on acceleration or deceleration up to about 2 g (i.e., 2 times the acceleration due to gravity) is satisfactory for both drop ejector arrays. However, printing on acceleration or deceleration (depending on carriage direction) at 3 g for the drop ejector array fed by ink passage 281 can cause excessive positive pressure, resulting in face flooding. The pressure at which the ink meniscus can break and lead to face flooding is also called the Laplace pressure, which is equal to the surface tension of the ink, divided by the nozzle diameter. For an ink surface tension of 35 dynes/cm and a 20 micron nozzle diameter, the Laplace pressure is approximately 8750 dynes/cm$^2$. As discussed above, the magnitude of the pressure increase is given by $|\Delta P|=\rho La$. For manifold passage 231, having a carriage-scan-axis projection of $L_1$=3 cm, $|\Delta P|$~6000 dynes/cm$^2$ for an acceleration of about 2 g. Therefore, a pressure increase of around 6000 dynes/cm$^2$ does not cause degradation of printing by face flooding, but a pressure increase of $|\Delta P|$~9000 dynes/cm$^2$, corresponding to an acceleration of 3 g, does cause printing degradation. By contrast, since manifold passage 233 has a carriage-scan-axis projection of $L_3$=1 cm, even at 3 g the pressure increase is only $|\Delta P|$~3000 dynes/cm$^2$, so there would not be printing degradation for the drop ejector array fed by ink feed passage 283 at 3 g.

Embodiments of the present invention use a different configuration of ink distribution than shown in FIGS. 5-7 and 9 in order to reduce the length of ink distribution lines such as manifold passages. In some embodiments, the actual length of the manifold passage is not decreased substantially, but the carriage-scan projection of the manifold passage is decreased, which reduces the effects of pressure surges in the manifold passages, as described above. In other embodiments, the actual length of the manifold passages is also decreased, which reduces not only effects of pressure surges, and also provides reduced susceptibility for the trapping of air.

Figure 10:
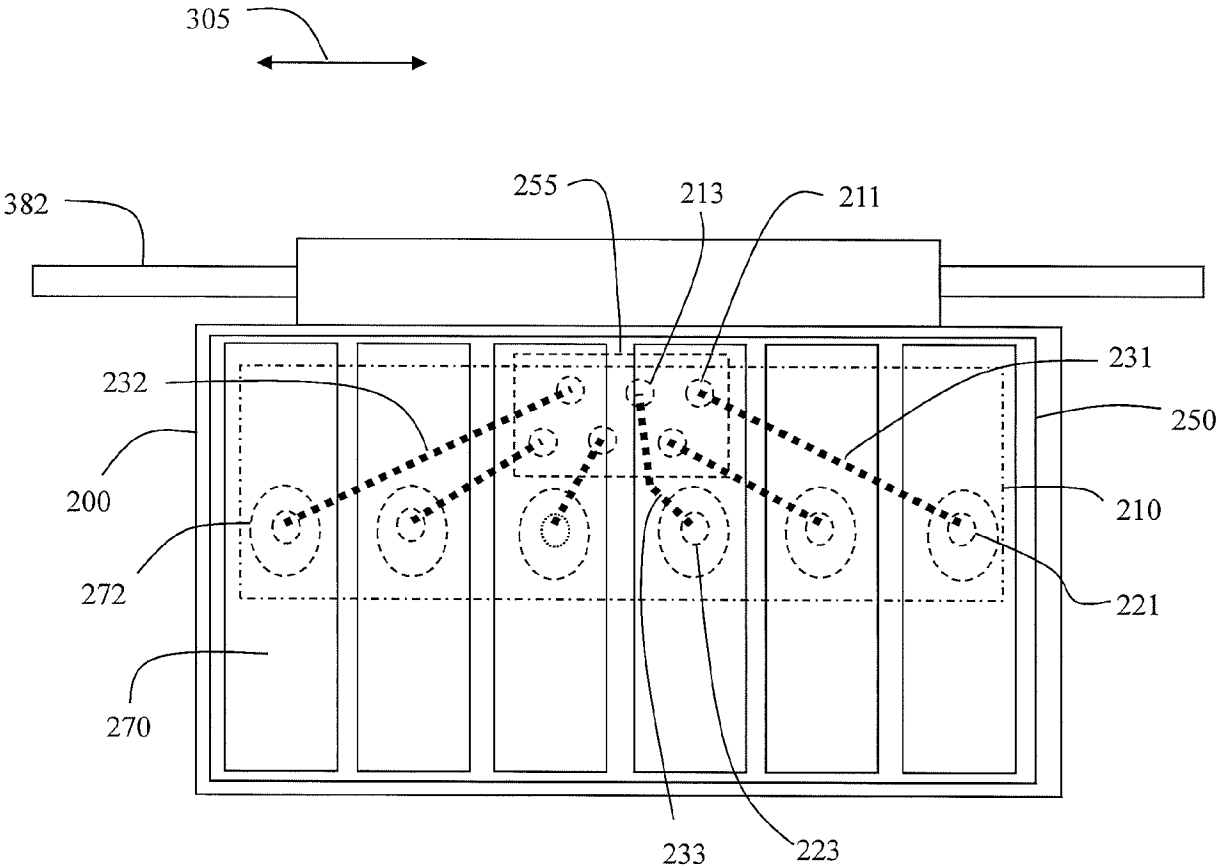
FIG. 10 Prior Art
FIG. 10 is a schematic top view of prior art printhead mounted in a carriage of a carriage printer.

For comparison, FIG. 10 shows a schematic top view of prior art printhead 250 (similar although not identical to FIG. 6) mounted on carriage 200, which is movable along carriage guide 382 in carriage scan direction 305. Printhead 250 includes ink supply connection ports 242 and 248 (FIG. 6) that are arranged in a row parallel to the carriage scan direction 305. Ink supply ports 272 of ink chambers 270 correspondingly are arranged in a row parallel to the carriage scan direction 305 as described above relative to FIG. 5. Prior art manifold 210 (similar to FIG. 9) includes manifold inlets 221 and 223 (for example) that are connected to corresponding manifold outlets 211 and 213 (to bring ink to mounting support member 255) by manifold passages 231 and 233 respectively. As described above relative to FIG. 9, manifold passage 233 has a significantly larger carriage-scan projection than does manifold passage 231.

Figure 11:
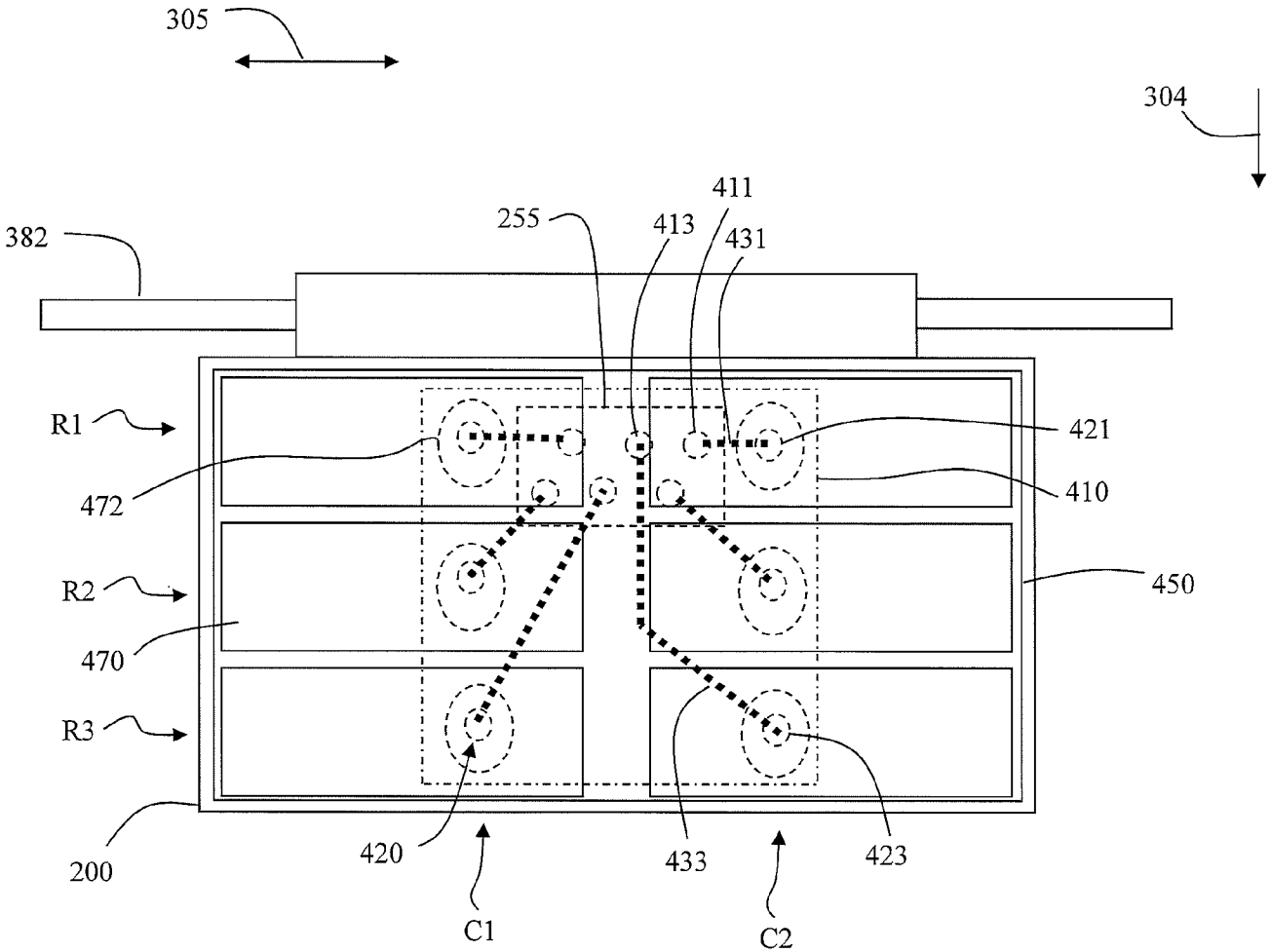
FIG. 11 is a schematic top view of an embodiment of the invention including a printhead mounted in a carriage.

By contrast, FIG. 11 shows a schematic top view of an embodiment of the present invention having a different ink distribution configuration than that shown in FIG. 10. A printhead 450, ink sources 470 and a manifold 410 are mounted on carriage 200, which is movable along carriage guide 382 in carriage scan direction 305. Printhead 450 includes ink supply connection ports (not shown) that are arranged in two columns having three rows each. Ink supply ports 472 of ink sources 470 correspondingly are arranged in two columns C1 and C2 having three rows each (R1, R2 and R3), where the rows are disposed substantially parallel to the carriage scan direction 305 and the columns are disposed substantially perpendicular to the carriage scan direction 305, i.e. along media advance direction 304. The ink supply ports 472 of each ink source 470 are detachably fluidically connected to corresponding inlets of the manifold 410. Manifold 410 includes manifold inlets 420 (six in this example, including manifold inlets 421 and 423) that are connected to corresponding manifold outlets including manifold outlets 411 and 413 (to bring ink to mounting support member 255 and thereby to respective nozzle arrays) via manifold passages 431 and 433 respectively. By comparing FIG. 11 to FIG. 10 it can be seen that all of the manifold passages including 431 and 433 in the embodiment shown in FIG. 10 have significantly shorter carriage-scan projections than those of manifold passages 231 and 235 of the prior art. For clarity, not all of the manifold inlets 420, ink supply ports 472 and ink sources 470 are individually labeled, but will rather be specified here by row number and column number. For example, manifold inlet 421 is referred to as manifold inlet 420 (C2, R1). In the configuration shown in FIG. 11, second manifold inlet 420 (C2, R1) is spaced apart from first manifold inlet 420 (C1, R1) along carriage scan direction 305. Third manifold inlet 420 (C1, R2) is spaced apart from first manifold inlet 420 (C1, R1) along the media advance direction 304. Similarly second ink supply port 472 (C2, R1) is spaced apart from first ink supply port 472 (C1, R1) along carriage scan direction 305, and third ink supply port 472 (C1, R2) is spaced apart from first ink supply port 472 (C1, R1) along the media advance direction 304. Fourth manifold inlet 420 (C2, R2) is spaced apart from second manifold inlet (C2, R1) along the media advance direction 304. In the example of FIG. 11, fourth ink supply port 472 (C2, R2) is spaced apart from second ink supply port 472 (C2, R1) along media advance direction 304; and fourth ink supply port 472 is spaced apart from third ink supply port 472 (C1, R2) along the carriage scan direction.

In some embodiments, the width of the ink sources 470 along a media advance direction 304 is sufficiently large that the spacing between the third ink supply port 472 (C1, R2) and the first ink supply port 472 (C1, R1) along media advance direction 304 is greater than the array length $L_A$ of nozzle array 253 (see FIG. 8).

In the example shown in FIG. 11, a spacing between third ink supply port 472 (C1, R2) and fourth ink supply port 472 (C2, R2) along the carriage scan direction 305 is substantially equal to a spacing between the first ink supply port 472 (C1, R1) and the second ink supply port 472 (C2, R1) along carriage scan direction 305. However in some embodiments the spacings are not the same.

In some embodiments, the spacing between first ink supply port 472 (C1, R1) and second ink supply port 472 (C2, R1) is less than twice the largest separation distance between the outermost nozzle arrays 253 (i.e. less than twice $s_3$ in the example of FIG. 8).

In some embodiments (although not in the example of FIG. 11), the spacing between the fourth ink supply port 472 (C2, R2) and the second ink supply port 472 (C2, R1) along the media advance direction 304 is greater than the spacing between the first ink supply port 472 (C1, R1) and the second ink supply port 472 (C2, R1) along the carriage scan direction 305.

In the example shown in FIG. 11, the plurality of ink sources 470 are arranged in at least two rows and at least two columns. The ink sources 470 in a same column are separated from each other along the media advance direction 304, and the ink sources 470 in a same row are separated from each other along the carriage scan direction 305. Furthermore, the ink supply ports 472 corresponding to the plurality of ink sources 470 are also arranged in at least two columns and two rows. The ink supply ports 472 in a same column are separated from each other along the media advance direction 304, and the ink supply ports 472 in a same row are separated from each other along the carriage scan direction 305. In some embodiments, a spacing between two ink supply ports 472 in a same column is greater than the array length $L_A$ of a nozzle array 253 (FIG. 8). In some embodiments, those two ink supply ports correspond to two outermost ink sources 470, such as (C1, R1) and (C1, R3) in the same column. In some embodiments, the spacing between two ink supply ports 472 in a same column is greater than a spacing between two ink supply ports 472 in a same row.

Figure 12:
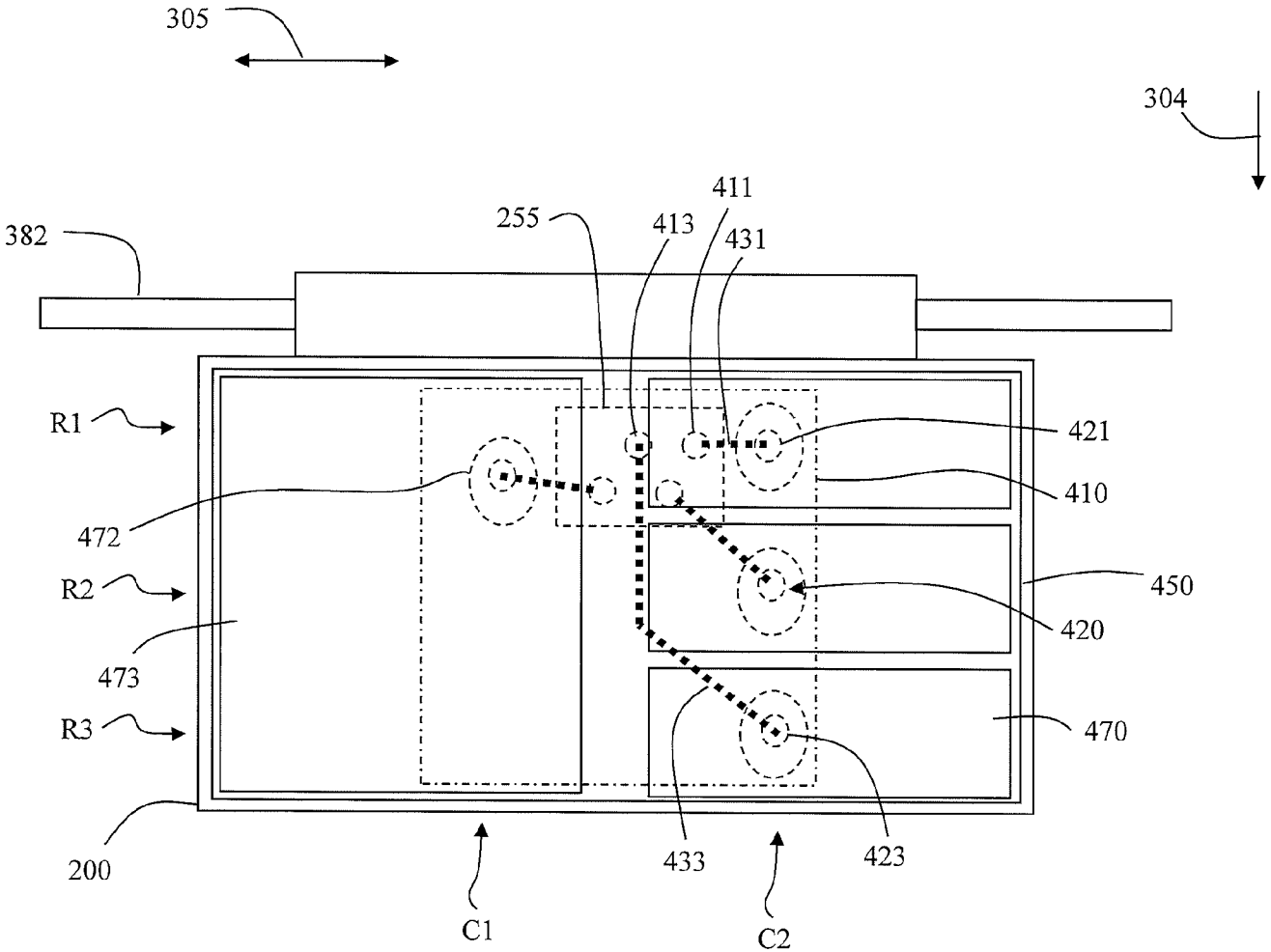
FIG. 12 is a schematic top view of another embodiment of the invention including a printhead mounted in a carriage.

Another exemplary embodiment is shown in the schematic top view of FIG. 12. Parts that are similar to the embodiment shown in FIG. 11 will not be described again. In the embodiment of FIG. 12, there is only a single ink source 473 (for example, black) in column 1, and three ink sources 470 (for example, cyan, magenta and yellow) in column 2. In the configuration shown in FIG. 12, second manifold inlet 420 corresponding to ink source 473 in C1 is spaced apart from first manifold inlet 420 (C2, R1) along carriage scan direction 305. Third manifold inlet 420 (C2, R2) is spaced apart from first manifold inlet 420 (C2, R1) along the media advance direction 304.

Figure 13:
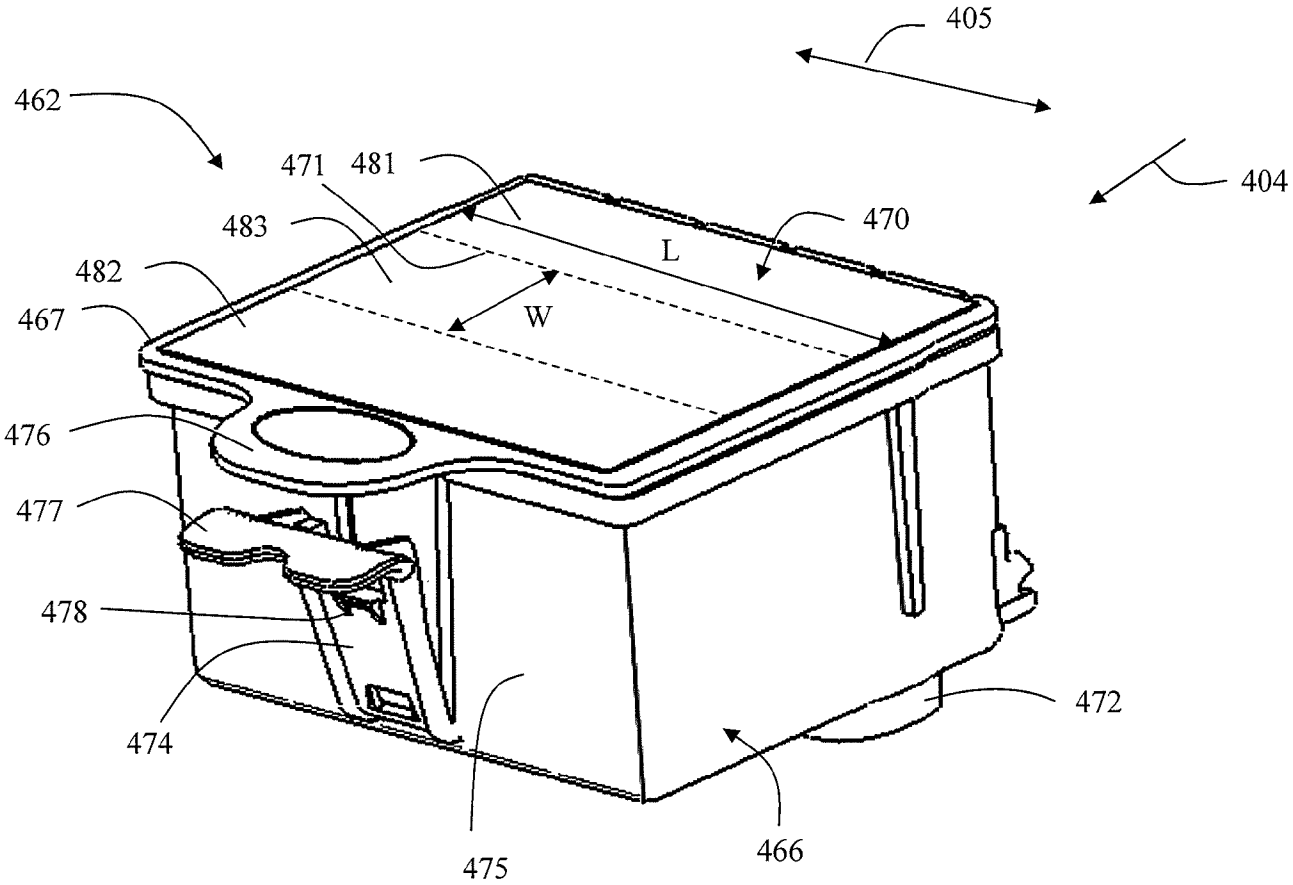
FIG. 13 is a perspective view of an ink tank according to an embodiment of the invention.

In some embodiments (including the configurations shown in FIGS. 11 and 12), a plurality of ink sources 470 are included within a detachably mountable first ink tank, such that a first ink source 470 (C2, R1) is disposed proximate the carriage guide 382 and a second ink source 470 (C2, R2) or (C2, R3) is disposed distal to the carriage guide 382. FIG. 13 shows a perspective of an exemplary embodiment of such an ink tank 462 that includes three ink sources 470 separately contained in chambers 481, 482 and 483 that are separated by internal walls 471. Ink tank 462 includes all three ink sources 470 corresponding to column C1 or column C2 of the embodiment shown in FIG. 11, or all three ink sources 470 corresponding to column C2 of the embodiment shown in FIG. 12. Only one ink supply port 472 is shown in FIG. 13, but the configuration of ink supply ports 472 would typically be as shown in column C2 of FIGS. 11 and 12. In particular, there is a first ink supply port 472 corresponding to a first ink source 470 within chamber 481 and a second ink supply port 472 corresponding to a second ink source within chamber 482, such that the second ink supply port 472 is separated from the first ink supply port 472 by a first direction 404 (same as the media advance direction 304 in when the ink tank 462 is mounted on the printhead 450 in carriage 200 in FIGS. 11 and 12).

Ink tank 462 includes a body 466 and a lid 467. A protruding grip 476 extends from lid 467. A lever 474 extends from an exterior wall 475 of body 466. Lever 474 includes a latch 478 and an opposing grip 477. In these ways, the exterior of ink tank 462 is similar to the exterior of prior art multi-chamber ink supply 262 discussed above relative to FIGS. 5 and 6, and facilitates installation of ink tank 462 into printhead 450. Differences between ink tank 462 and multi-chamber ink supply 262 include the separation direction of the ink supply ports 472 as opposed to ink supply ports 272, and the arrangements of the chambers. In particular, in ink tank 462, exterior wall 475 from which latch 478 extends is adjacent to a second ink source 470 in chamber 482, but is not adjacent to a first ink source 470 in chamber 481. In prior art multi-chamber ink supply 262, exterior wall 275 is common to all five chambers 270. Similarly the handle, including protruding grip 476 and opposing grip 477, is disposed proximate to the second ink source 470 in chamber 482, but is distal to the first ink source 470 in chamber 481. Additionally, using the convention that length L is greater than width W, for ink tank 462, the width of ink source 470 in chamber 481 extends along a direction that is perpendicular to exterior wall 475 and the length extends along a direction that is parallel to exterior wall 475. For multi-chamber ink supply 262, the width of chamber 270 extends along a direction that is parallel to exterior wall 475 and the length extends along a direction that is perpendicular to exterior wall 475. When ink tank 462 is installed in the printhead 450 in carriage 200, the width of ink source 470 in chamber 481 is disposed along media advance direction 304 and the length is disposed along carriage scan direction 305.

In the example shown in FIGS. 11 and 13, a third ink source 470 within chamber 483 is disposed between the first ink source 470 in chamber 481 and the second ink source 470 in chamber 482. The third ink supply port 472 is disposed in line with the first ink supply port 472 and the second ink supply port 472. In some embodiments ink tank 462 includes ink sources 470 within chambers that are arranged in a plurality of columns as well as a plurality of rows. In such embodiments, a third ink supply port can be offset from the first ink supply port along a second direction 405 that is perpendicular to the first direction 404. For such an ink tank that is mounted in printhead 450 in carriage 200 (FIG. 11), the third ink source 470 is offset from the first ink source 470 along the carriage scan direction 405.

Figure 14:
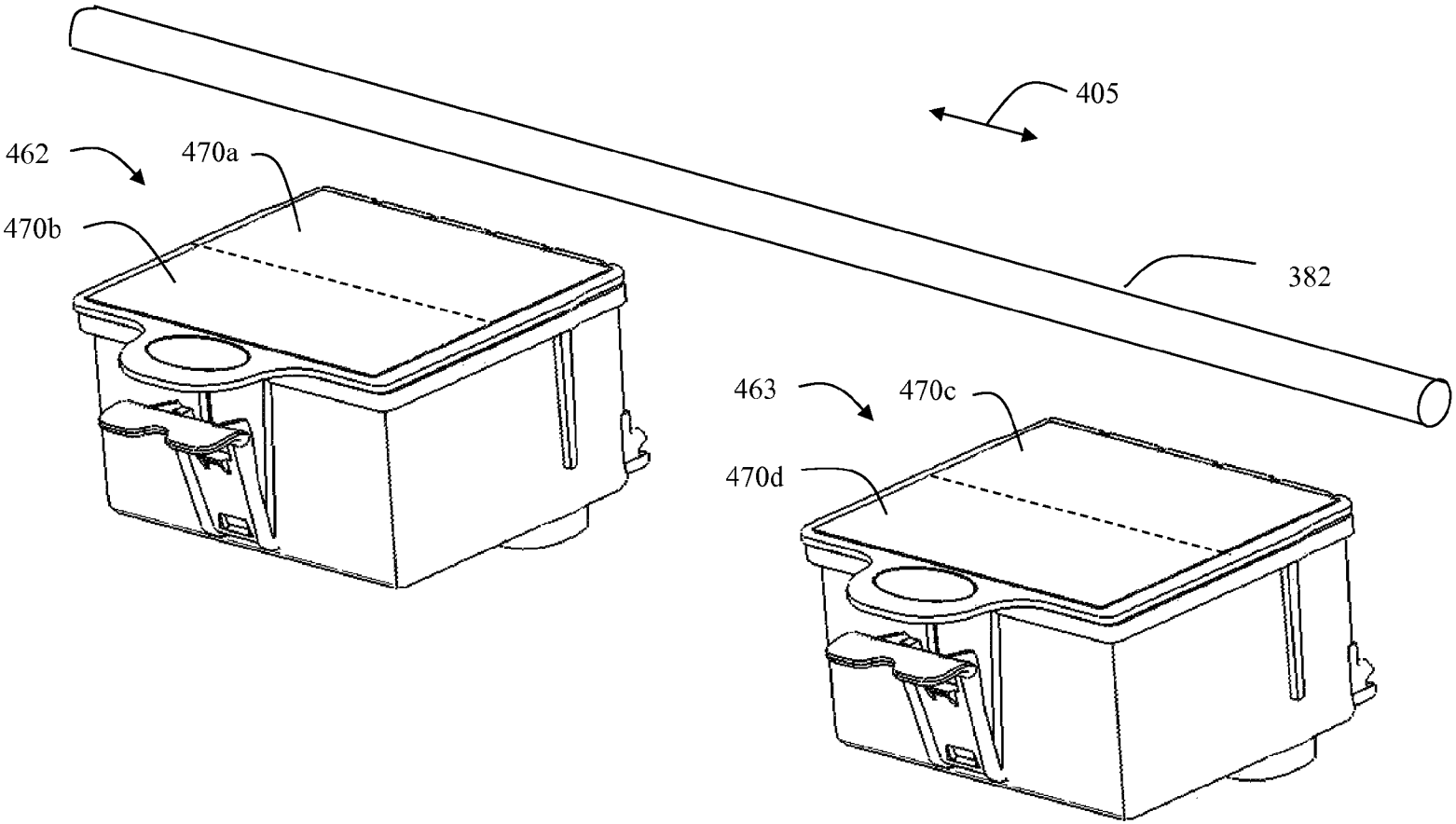
FIG. 14 is a perspective view of a first ink tank and a second ink tank according to an embodiment of the invention.

For embodiments in which first ink tank 462 includes ink sources 470 in chambers that are arranged in a single column, a second ink tank 463 is installed in printhead 450, and separated from first ink tank 462 along the carriage scan direction 305, as shown in FIG. 14. For examples similar to FIG. 11, the second ink tank can be similar to first ink tank 462, except including different inks in the chambers. In the first ink tank 462, a first ink source 470*a* is disposed proximate to the carriage guide 382 and second ink source 470*b* is disposed distal to the carriage guide 382. In the second ink tank 463, as in first ink tank 462, a third ink source 470*c* is disposed proximate to the carriage guide 382 and a fourth ink source 470*d* is disposed distal to the carriage guide 382. For examples similar to FIG. 12, the second ink tank can include a single chamber to hold ink source 473.

The invention has been described in detail with particular reference to certain preferred embodiments thereof, but it will be understood that variations and modifications can be effected within the spirit and scope of the invention.

PARTS LIST

12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzles
122 First ink delivery pathway
130 Second nozzle array
131 Nozzles
132 Second ink delivery pathway
181 Ink droplets
182 Ink droplets
200 Carriage
210 Manifold
211 Manifold outlet
212 Manifold outlet
213 Manifold outlet
214 Manifold outlet
215 Manifold outlet
216 Manifold outlet
221 Manifold inlet
222 Manifold inlet
223 Manifold inlet
224 Manifold inlet Parts List cont'd

225 Manifold inlet
226 Manifold inlet
231 Manifold passage
232 Manifold passage
233 Manifold passage
234 Manifold passage
235 Manifold passage
236 Manifold passage
237 Elongated opening
238 Opening
241 Multi-chamber ink supply region
242 Multi-chamber ink supply connection port
246 Single-chamber ink supply region
248 Single-chamber ink supply connection port
249 Partitioning wall
250 Printhead
251 Printhead die
252 Ink feeds
253 Drop ejector arrays
254 Drop ejector array direction
255 Mounting support member
256 Encapsulant
257 Flex circuit
258 Connector board
260 Ink entry surface
261 Die attach surface
262 Multi-chamber ink supply
264 Single-chamber ink supply
266 Ink supply body Parts List cont'd

267 Lid
268 Lid sealing interface
269 Vents
270 Ink chamber
271 Internal walls (between chambers)
272 Ink supply ports
274 Lever
275 Exterior wall
276 Protruding grip
277 Opposing grip
278 Latch
281 Ink feed passage
282 Ink feed passage
283 Ink feed passage
284 Ink feed passage
285 Ink feed passage
286 Ink feed passage
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller Parts List cont'd

313 Forward rotation direction
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide
383 Encoder fence

384 Belt
390 Printer electronics board
392 Cable connectors
404 first direction
405 Carriage scan direction
410 Manifold
411 Manifold outlet
413 Manifold outlet
420 Manifold inlet
421 Manifold inlet
423 Manifold inlet
431 Manifold passage
433 Manifold passage
450 Printhead
462 Ink tank
466 Body
467 Lid Parts List cont'd

470 Ink source
471 Internal wall
472 Ink supply port
473 Ink source
474 Lever
475 Exterior wall
476 Protruding grip
477 Opposing grip
478 Latch
481 Chamber
482 Chamber
483 Chamber

The invention claimed is:

1. An inkjet printer comprising:

a carriage guide extending along a carriage scan direction;

a print region;

a media advance system for advancing media across the print region in a media advance direction;

an inkjet printhead including a plurality of nozzle arrays;

a plurality of ink sources that are detachably mountable to the inkjet printhead, wherein a first ink source and a second ink source of the plurality of ink sources are included within a first ink tank, the first ink source is disposed proximate to the carriage guide and the second ink source is disposed distal to the carriage guide when the first ink tank is in an installed configuration in the inkjet printhead that is operable for printing; and a carriage configured to move the inkjet printhead and the plurality of ink sources across the print region along the carriage scan direction.

2. The inkjet printer of claim 1, the first ink tank further including a latch disposed proximate to the second ink source and distal to the first ink source.

3. The inkjet printer of claim 1, the first ink tank further including a handle disposed proximate to the second ink source and distal to the first ink source.

4. The inkjet printer of claim 1, the first ink source further including a width along the media advance direction and a length along the carriage scan direction, wherein the length is greater than the width.

5. The inkjet printer of claim 1, the first ink tank further including a third ink source disposed between the first ink source and the second ink source.

6. The inkjet printer of claim 1, the first ink tank further including a third ink source that is offset from the first ink source along the carriage scan direction.

7. The inkjet printer of claim 1 further including a second ink tank that is separated from the first ink tank along the carriage scan direction.

8. The inkjet printer of claim 7, the second ink tank including a third ink source disposed proximate to the carriage guide and a fourth ink source disposed distal to the carriage guide.

* * * * *